United States Patent [19]

Downs et al.

[11] Patent Number: 5,043,684

[45] Date of Patent: Aug. 27, 1991

[54] COMPACT HIGH POWER, HIGH DIRECTIVITY, WAVEGUIDE DIRECTIONAL COUPLER UTILIZING REACTIVELY LOADED JUNCTION

[75] Inventors: Henry Downs, Portland; Richard I. Bibber, Gray, both of Me.

[73] Assignee: General Signal Corporation, Stamford, Conn.

[21] Appl. No.: 429,540

[22] Filed: Oct. 31, 1989

[51] Int. Cl.[5] ..... H01P 5/18

[52] U.S. Cl. ..... 333/111; 333/113

[58] Field of Search ..... 333/111, 113, 114

[56] References Cited

U.S. PATENT DOCUMENTS 4,691,177 9/1987 Wong et al. ..... 333/113

4,818,964 4/1989 Wong ..... 333/113 X

*Primary Examiner*—Paul Gensler

*Attorney, Agent, or Firm*—Robert R. Hubbard; John F. Ohlandt

[57] ABSTRACT

A directional coupler for coupling r.f. energy in a waveguide system from a main channel waveguide to a subsidiary channel waveguide, the coupling being in the range between about −3 dB to −15 dB. The coupler comprises a single coupling slot at the junction between the main channel waveguide and the subsidiary channel waveguide with an arrangement for decoupling the slot to yield the desired coupling, the arrangement including first and second posts in the plane of the junction. A further provision involves inductively loading the junction, the loading being provided at the plane of the junction. The provision for inductively loading the junction is an "inverted" button, in the form of capped-off holes, the depth of the holes being adjusted to vary the directivity of the coupler.

4 Claims, 2 Drawing Sheets

COMPACT HIGH POWER, HIGH DIRECTIVITY, WAVEGUIDE DIRECTIONAL COUPLER UTILIZING REACTIVELY LOADED JUNCTION

The present invention is a very compact, high power, high directivity, waveguide coupler primarily used for coupling r.f. energy in a waveguide antenna feed of a radar system.

BACKGROUND OF THE INVENTION

Waveguide directional couplers are widely used in applications such as the combining of power from a plurality of low power signal sources to generate higher power signals, for signal sampling, for comparing the power applied to and reflected from an antenna, in beam forming networks in multi-horn antenna arrays, in non-contact phase shifting switching schemes, and the like.

In general, a waveguide branch directional coupler includes two generally parallel through waveguides which are connected together by two or more branch waveguides. The relative amount of power coupled from one of the through waveguides to the other is determined by the amount of power flowing in the branch waveguides, which, in turn, depends upon the relative dimensions of the branch waveguide and the through waveguide to which the signal is applied. The couplers are often manufactured by machining slots into a solid block of metal to form a conductive housing. A separate cover closes the housing.

Various waveguide directional couplers are set forth in U.S. Pat. Nos. 4,679,011 (Praba et al ), issued July 7, 1987, U.S. Pat. No. 4,127,831 (Riblet), issued Nov. 18, 1978, and U.S. Pat. No. 4,792,770 (Parekh et al.), issued Dec. 20, 1988.

The Praba et al. patent discloses a waveguide branch directional coupler which includes a conductive housing which defines first and second mutually parallel waveguides and a chamber which extends therebetween. The width of the chamber is equal to the width of the waveguides. The length of the chamber in a direction parallel to the axes of the waveguides is fixed for all members of a family of coupling values. The coupler includes one or more rectangular conductive blocks dimensioned to extend between the waveguides. The conductive blocks are so dimensioned that when fastened in place within the chamber they define two or more branch waveguides extending between the parallel waveguides.

The Riblet patent discloses a symmetrical two branch coupler comprised of four sections of signal transmission line interconnected so as to form at the junction therebetween four ports of the coupler with oppositely disposed lines having like characteristic admittances. The two branch coupler includes at least two 2-port matching networks connected at two of the four ports of the coupler with each matching network connected at its associated port and independent of connection to the other ports.

The parekh et al. patent discloses a directional coupler which includes a first waveguide and a longitudinal septum dividing the first waveguide into plural longitudinal channels at least in a coupling region. Additional waveguides are coupled by directional coupling apertures to the longitudinal channels of the first waveguide.

Whatever the merits of the above-cited patented devices for their intended purposes, they are not viewed as particularly pertinent to the context and objectives of the present invention.

In the context of a conventional weather radar system, it has been found that providing conventional multi-hole sidewall couplers having a coupling factor of −20 dB results in an insufficient signal at the weather channel. The multi hole sidewall coupler typically diverts 1% of the incoming power (r.f. energy) to the weather channel, whereby the diverted incoming power is so small that nothing can be seen at the weather channel.

FIG. 1 attached hereto depicts a typical radar system 1 which includes antenna 2, circulator 3, multi-hole sidewall coupler 4, weather channel 5, and target channel 6. Incoming power from antenna 2 passes through circulator 3 and is loaded in coupler 4, wherein the approximately 1% of the incoming power is diverted to weather channel 5, an amount totally insufficient for viewing purposes.

In response to the above-stated problem of insufficient power in the weather channel. It might be thought that the most cost-effective solution would be simply to couple more power into the weather channel. The difficulty in a multi-hole sidewall coupler is that such a solution involves increasing the length of the coupler substantially.

Accordingly, it is a primary object of the present invention to realize an efficient directional coupler for use in weather radar systems by providing a compact device capable of producing sufficiently high power levels in a subsidiary channel, while insuring high directivity.

Briefly, the primary feature of the present invention derives from the recognition that a known, short slot, 3 dB hybrid waveguide can be successfully exploited. By appropriately decoupling the slot using judiciously placed first and second posts in the junction defined by the slot, the basic objectives sought can be achieved. Further, the depth of an "inverted" button, as it is sometimes called which is in the form of a capped-off hole or holes, is used to insure that the requisite directivity is achieved. It will be appreciated by those skilled in the art as the description proceeds that there is a balance required between the aforenoted dimensions for any given coupling value, that is, the dimensions involving spacing between posts, and the depth of the capped-off holes.

The directional coupler according to the present invention also provides the following advantages over conventional multi- hole couplers: it can be used with varying frequencies to achieve coupling, from −3 dB to −15 dB, to a subsidiary channel; it allows for controlling directivity over varying frequencies; it avoids having to manufacture or replace couplers for varying frequencies; and it can use the full power capability of coupler waveguides, while still remaining compact.

A substantial advantage of this type of compact waveguide coupling device is in the formation of antenna beam forming networks (BFN) for both earth station and satellite applications. The size reduction allows for a much more compact BFN giving maneuverability advantages in earthborne applications. The size and, more importantly, the weight differs immense advantages in satellite BFNs where any weight reduction extends the useful life of a satellite.

Additional advantages of the present invention shall become apparent as described below.

SUMMARY OF THE INVENTION

A directional coupler for coupling r.f. energy in waveguide means from a main channel waveguide to a subsidiary channel waveguide, the coupling being in the range between about −3 dB to −15 dB. The coupler comprises: a single coupling slot at the junction between the main channel waveguide and the subsidiary channel waveguide; mean for decoupling the slot to yield the desired coupling, the means including a first and second post in the plane of the junction; and means for inductively loading the junction so as to enable a directivity in excess of −30 dB, the loading being provided at the plane of the junction. The coupling factor of the coupler is adjusted by changing the spacing between the first and second posts.

The junction section of the coupler may also include additional sidewall posts; whereby the effective distance between the sidewalls of the coupler can be reduced.

The means for inductively loading the junction is an "inverted" button, in the form of capped-off holes, the depth of the holes being adjusted to vary the directivity, whereby a directivity in excess of −35 dB at a single frequency and more than −30 dB over an 8 percent bandwidth can be realized.

The present invention may also include many additional features which shall be further described below.

DESCRIPTION OF THE PREFERRED EMBODIMENT

The present invention is a compact, high power, high directivity, waveguide directional coupler primarily used for coupling incoming signal power to a weather radar system. The coupler of the present invention is capable of increasing the strength of r.f. energy diverted to a weather channel of a radar system in order to produce a satisfactory signal. Moreover, this coupler is also capable of changing certain critical dimensions for adjusting both its coupling and directivity according to the particular needs of the radar system.

In order to produce a sufficiently strong signal at the weather channel, the present inventor undertook the task of developing a coupler capable of diverting more incoming power to the weather channel. As noted previously, the coupler developed by the present inventor uses a short slot −3 dB hybrid which is decoupled by means of decoupling posts, preferably in the junction plane.

The present inventor also found that coupling could be varied substantially by changing the spacing between the decoupling posts. However, it was observed from tests that were conducted that if this was the only change the directivity of the device was destroyed. The coupler of the present invention was modified to include a novel directivity controlling device, i.e., an "inverted" button in the form of capped-off holes which act as an inductive load right at the plane of the junction. By adjusting the .depth of the holes, i.e., by changing the cap dimensions, the directivity of the coupler can be varied.

Figure 1:
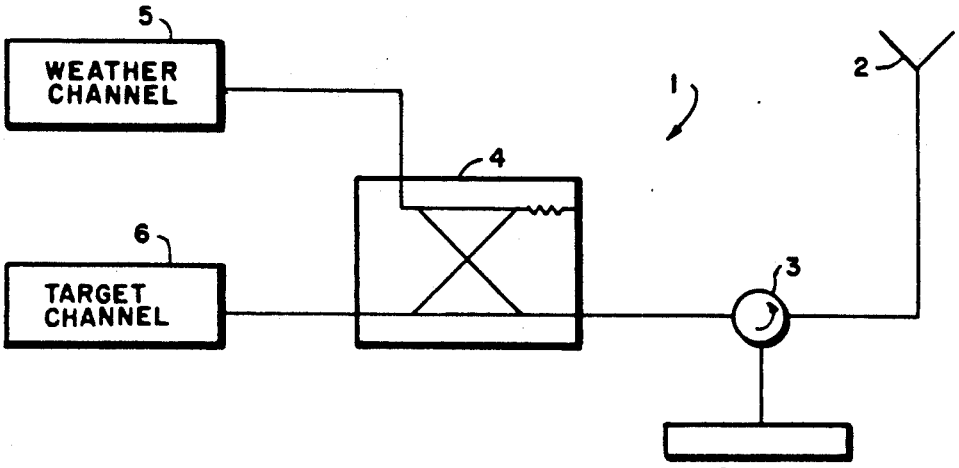
FIG. 1 is a schematic diagram of a weather radar system with a coupler.
Figure 2:
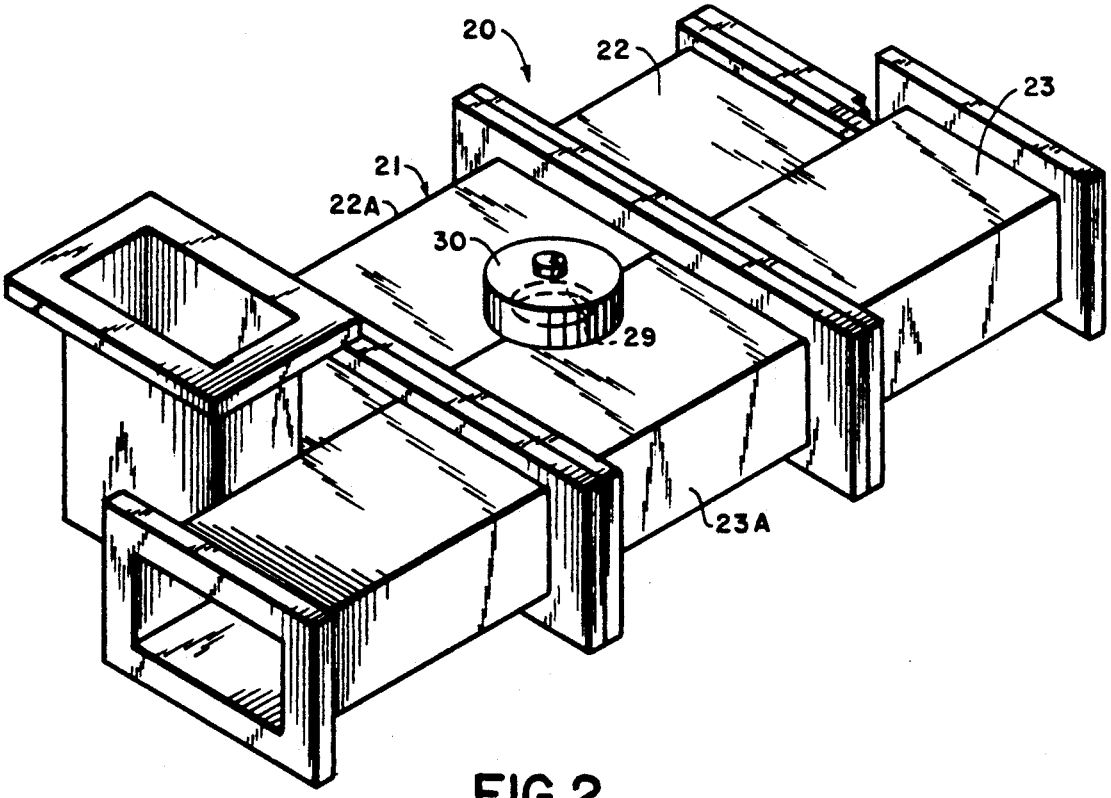
FIG. 2 is a perspective view of the coupler according to the present invention.
Figure 3:
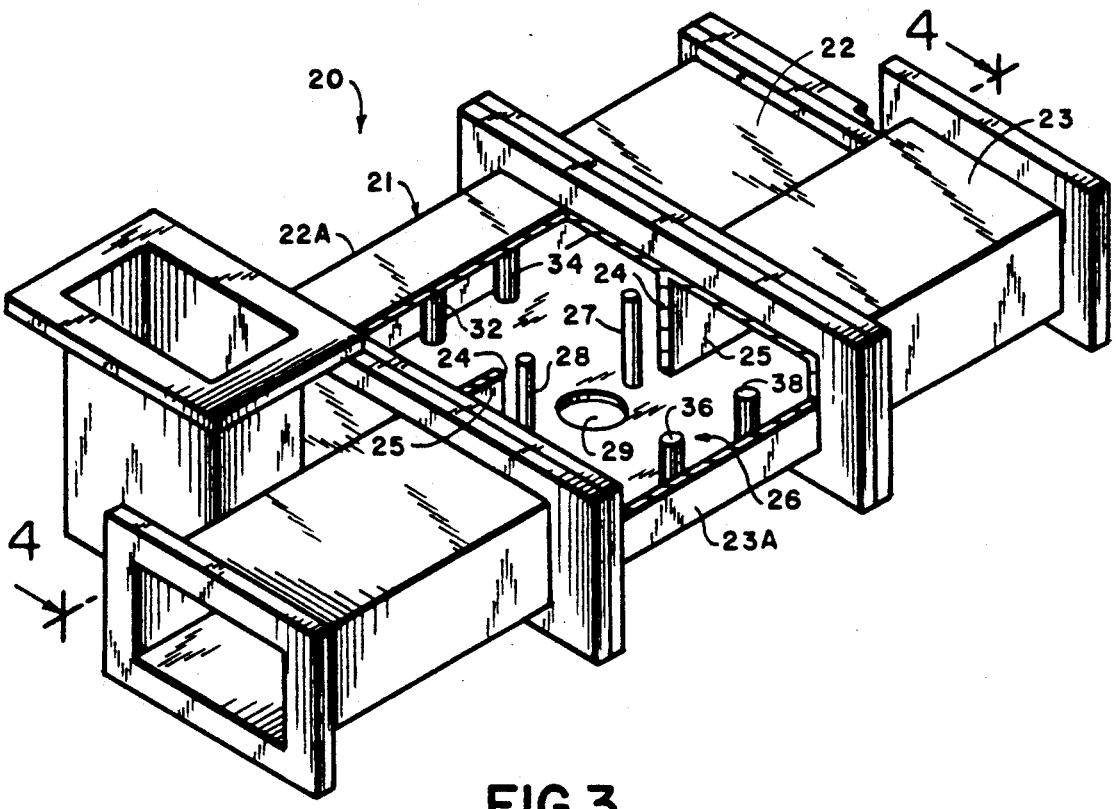
FIG. 3 is another perspective view suitably broken away to show parts of the coupler.
Figure 4:
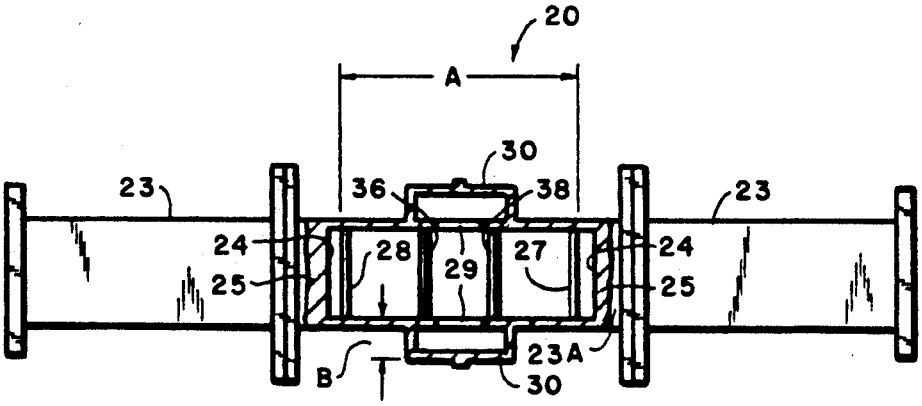
FIG. 4 is a vertical sectional view taken on the line 4—4 in FIG. 3.

The novel coupler is best described by referring to FIGS. 2–4. FIG. 2 depicts a directional coupler 20 for coupling r.f. energy in a waveguide means 21 from a main channel waveguide 22 to a subsidiary channel waveguide 23, the coupling being in the range between about −3 dB to −15 dB. Coupler 20 comprises: a single coupling slot 24 in the common wall 25 of the waveguide means 21, which slot defines a planar junction 26 between main channel waveguide 22 and subsidiary channel waveguide 23. The means for decoupling the slot 24 to yield the desired coupling includes a first post 27 and a second post 28 in the plane of junction 26. The means for inductively loading junction 26 is provided so as to achieve directivity in excess of −30 dB, the loading being provided at the plane of junction 26. The means for inductively loading junction 26 is an "inverted" button, in the form of capped-off holes 29, the caps 30 for the holes being seen at the top and bottom of the coupler in FIG. 4. The depth of holes 29 is effectively adjusted to vary the directivity for coupler 20 by selectively providing suitably dimensioned caps 30, which as seen project above the top and bottom of the coupler. Directivity in excess of −35 dB at a single frequency and more than −30 dB over an 8 percent bandwidth can be realized.

It is to be noted that the caps 30 are shown as having an attached relationship with the waveguide means. It will be understood, however, that these caps are trimmed to provide the precise dimension B required for a given situation, that is, to achieve the required directivity. They are then welded or otherwise affixed to the walls of the waveguide. Of course, if so desired, variability in the depth of the holes 29 could be achieved by a threaded or other detachable connection between the caps and the waveguide walls.

The coupling of coupler 20 is varied by varying the spacing (dimension A - FIG. 4) between first post 27 and second post 28. For example, a coupler 20 which is operable with f energy in the range between about 1250 and 1350 MHz would preferably have a spacing between first post 27 and second post 28 of approximately 7.3 inches, and a post diameter of about a quarter inch.

Another example is a coupler 20 which is operable with rf energy in the range between about 885 and 925 MHz would preferably have spacing between first post 27 and second post 28 of approximately 5.56 inches, and a post diameter of about 3/8 of an inch.

The additional sidewall posts, whose function has already been explained, are best seen in FIGS. 3 and 4. These posts are labelled 32, 34, 36, and 38. These posts have a diameter of about ½ of an inch. Pairs of these posts, for example, the pair 32 and 34, are located approximately 0.56 inches from the outer wall 22A of the waveguide 22; whereas the other pair, that is, posts 36 and 38 are likewise spaced from the other outer wall 23A of the waveguide 23. The spacing between posts of each pair, that is, for example, between posts 32 and 34 and between posts 36 and 38 is approximately 2.75 inches.

In order to enable one skilled in the art to construct the directional coupler of the present invention, further details are here given with respect to particularly significant dimensions of parts, as well as test data obtained with physical embodiments operated over particular frequency ranges. As noted previously, a particular coupler tested over a range of frequencies from 1250 MHz to 1350 MHz had a spacing between the quarter inch decoupling posts 27 and 28 of 7.3 inches (A dimension, FIG. 4). in addition, this particular coupler had a hole depth (B dimension, FIG. 4) of 0.90 inches. The test data for such coupler is seen in Table I below.

TABLE I

| FREQUENCY (MHz) | COUP-LING | DIREC-TIVITY | VWSR MAIN | VWSR SUBSIDIARY |
|---|---|---|---|---|
| 1250 | −5.95 | 30 | 1.05 | 1.02 |
| 1275 | −6.05 | 34 | 1.03 | 1.03 |
| 1300 | −6.03 | 48 | 1.04 | 1.02 |
| 1325 | −6.04 | 38 | 1.04 | 1.02 |
| 1350 | −6.00 | 38 | 1.05 | 1.03 |

It should be noted also that this coupler had a slot length of approximately 8 inches.

It should also be noted that another coupler was tested at a different frequency range and as noted previously, its frequency range being 896 to 915 MHz. However, this coupler had a hole depth of approximately 0.2 inches, the slot length being approximately 13 inches.

While 1 have shown and described several embodiments in accordance with my invention, it is to be clearly understood that the same are susceptible to numerous changes and modifications apparent to one skilled in the art. Therefore, 1 do not wish to be limited to the details shown and described but intend to show all changes and modifications which come within the scope of the appended claims.

What is claimed is:

1. A directional coupler for coupling r.f. energy in a waveguide means from a main channel waveguide to a subsidiary channel waveguide, said coupling being variable within the range between a out —3 dB to −15 dB, said coupler comprising:

a single coupling slot at the junction between said main channel waveguide and said subsidiary channel waveguide;

means for decoupling said slot to yield the desired coupling, said means including two posts int eh plane of said junction; and means for inductively loading said junction so as to enable a directivity in excess of —30 dB, said loading being provided at the plane of said junction;

wherein said means for inductively loading said junction comprises capped-off holes in the waveguide means, the depth of the hole being adjusted to vary the directivity of the coupler, whereby a directivity in excess of −35 dB at a single frequency and more than −30 dB over an 8 percent bandwidth is realized.

2. The directional coupler according to claim 1, in which for frequencies in the range between about 1250–1350 MHz, the spacing between said first and second posts is approximately 7.3 inches, and said first and second posts have a diameter of about a quarter inch.

3. The directional coupler according to claim 1, in which for frequencies in the range between about 885–925 MHz, the spacing between said first and second posts is approximately 5.56 inches, and said first and second posts have a diameter of about $\frac{3}{8}$ of an inch.

4. The directional coupler according to claim 1, further including additional sidewall posts such that the distance between the waveguide sidewalls of said coupler is effectively reduced, wherein said additional sidewall posts have a diameter of about $\frac{1}{2}$ of an inch, pairs of said posts being located approximately 0.56 inches from the respective outer walls of said waveguide means, the spacing between said pairs being approximately 2.75 inches.

* * * * *